US007171728B2

(12) United States Patent
Chirumbolo

(10) Patent No.: US 7,171,728 B2
(45) Date of Patent: Feb. 6, 2007

(54) CONTROL KNOB OF THE RETRACTABLE TYPE WITH SLOWED-DOWN EXTRACTION, IN PARTICULAR FOR AN ELECTRICAL HOUSEHOLD APPLIANCE

(75) Inventor: Dino Chirumbolo, Settimo Torinese (IT)

(73) Assignee: ITW Industrial Components S.R.L., Milan (IT)

( * ) Notice: Subject to any disclaimer, the term of this patent is extended or adjusted under 35 U.S.C. 154(b) by 249 days.

(21) Appl. No.: 10/829,657

(22) Filed: Apr. 22, 2004

(65) Prior Publication Data

US 2005/0039305 A1 Feb. 24, 2005

(30) Foreign Application Priority Data

Apr. 23, 2003 (IT) ..... TO2003A0315

(51) Int. Cl.
*G05G 1/06* (2006.01)

(52) U.S. Cl. ..... 16/441; 16/443; 16/429; 74/553

(58) Field of Classification Search ..... 16/441, 16/442, 429, DIG. 30, 433; 74/553, 554
See application file for complete search history.

(56) References Cited

U.S. PATENT DOCUMENTS 3,779,268 A * 12/1973 Conkling ..... 137/113
4,275,764 A * 6/1981 Baret ..... 137/614.19
4,779,305 A * 10/1988 Gorsek ..... 16/441
5,048,365 A * 9/1991 Webb ..... 74/553
5,364,065 A * 11/1994 Tauati ..... 251/96
5,551,124 A * 9/1996 Zeringue ..... 16/441
5,671,904 A * 9/1997 Minutillo ..... 251/96
6,112,619 A * 9/2000 Campbell ..... 74/553

FOREIGN PATENT DOCUMENTS

DE 3910967 A1 * 10/1990
DE 199 51 422 5/2001
JP 2003257289 A * 9/2003

* cited by examiner

*Primary Examiner*—Chuck Y. Mah
*Assistant Examiner*—Michael J. Kyle
(74) *Attorney, Agent, or Firm*—Lowe Hauptman & Berner, LLP

(57) ABSTRACT

A knob includes a hub to be fixed in a seat open at the front of an electrical household appliance, a grip, which can slide axially, against the action of an elastic element, on a first end of the hub. Between the grip and the hub there is defined a closed chamber having a variable volume that is a function of the axial position of the grip on the hub. A sliding seal is provided for sealing the closed chamber. A calibrated restriction connects the inside of the chamber with the external environment in such a way as to bring about a negative pressure in the chamber as a result of the axial movement of the grip away from the hub.

19 Claims, 1 Drawing Sheet

CONTROL KNOB OF THE RETRACTABLE TYPE WITH SLOWED-DOWN EXTRACTION, IN PARTICULAR FOR AN ELECTRICAL HOUSEHOLD APPLIANCE

TECHNICAL FIELD

The present invention relates to a control knob of the retractable type for electrical household appliances, otherwise known as "push-push" knob, wherein the grip thereof is slowed down in its motion of extraction from the seat for housing the knob on the household appliance.

BACKGROUND

It is known that, in all types of electrical household appliances (washing machines, dish washers, ovens, etc.) the control knob or knobs for controlling the various functions of the household appliance (for example, washing or cooking programs, temperature of the water, etc.) are controlled via rotatable grips. With increasing frequency said knobs are of the "retractable" type, in general obtained via a so-called "push-push" mechanism of a known type, which can be retracted into a purposely provided housing seat open at the front of the household appliance, for example made on the front panel, both for the purpose of reducing the overall dimensions and purely for reasons of styling.

Nowadays, there is strongly felt the need to enable extraction of the knob, i.e., of its gripping part, from the housing seat present on the household appliance, to be slowed down, in so far as this characteristic is particularly appreciated by users and, moreover, enables operation of the push-push mechanism to be rendered safer and more reliable. However, known devices for slowing down extraction cannot be applied to control knobs of electrical household appliances, basically both on account of their overall dimensions, given the extremely small space available, and for reasons of cost.

SUMMARY

The object of the present invention is to overcome the drawbacks described above by providing a control knob for household appliances of the type that can be retracted into a front seat of the household appliance by means a push-push device, the extraction thereof from the seat being slowed down by means of a mechanism which is reliable and presents small overall dimensions, low cost, and ease of installation.

In particular, it is an object of the invention to integrate the slowing-down mechanism in the very structure of the knob.

In particular, according to the invention, the control knob includes a cup-shaped grip mounted so that it can slide axially, against the action of elastic means, on a hub so as to define, between the grip and the hub, a closed chamber having a volume which depends upon the axial position of the grip on the hub. Between the hub and the grip there are moreover arranged sliding seal means for sealing the airtight chamber, and a calibrated restriction is carried by anyone of said hub and said grip to connect permanently the inside of the chamber with the external environment in such a way as to cause a variation of pressure of the air contained in the chamber as a result of any axial movement of the grip with respect to the hub, in particular a negative pressure in said chamber as a result of a movement of the grip towards an extracted position.

In this way, when the cup-shaped grip, which constitutes the part of knob that is visible and can be actuated by the user, (the rest of the knob being in use housed in a front seat of the household appliance) is pushed by the spring towards the extracted position (from the aforesaid seat), its motion of extraction from the seat, which entails a relative sliding with respect to the hub, brings about an increase in the volume of the aforesaid chamber, which cannot be compensated for immediately by the inlet of environmental air, on account of the presence of the sealing means and of the calibrated restriction. There is consequently brought about, in the chamber, a negative pressure, the value of which will depend upon the pressure drop through the calibrated restriction, which exerts a "sucking" action on the grip thus slowing down its motion of extraction.

BRIEF DESCRIPTION OF THE DRAWINGS

Further characteristics and advantages of the present invention will emerge clearly from the following description of non-limiting embodiments thereof, with reference to the figures of the annexed drawings, in which.

DETAILED DESCRIPTION OF EMBODIMENTS

Figure 1:
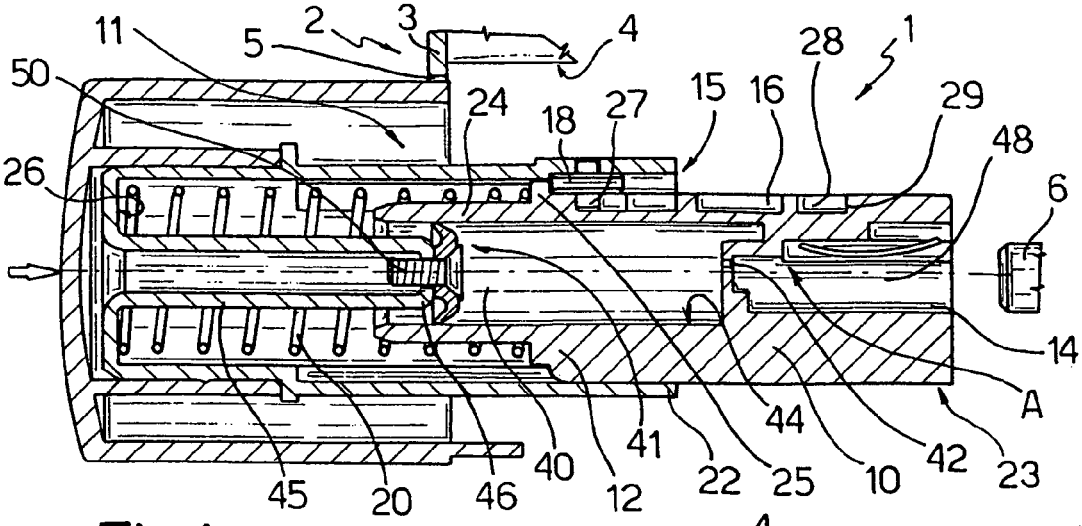
FIG. 1 is a longitudinal elevation view, sectioned along the axis of symmetry, of a control knob made according to the invention, represented in the operating position, extracted with respect to a front seat provided in a household appliance, illustrated only partially and in exploded view.
Figure 2:
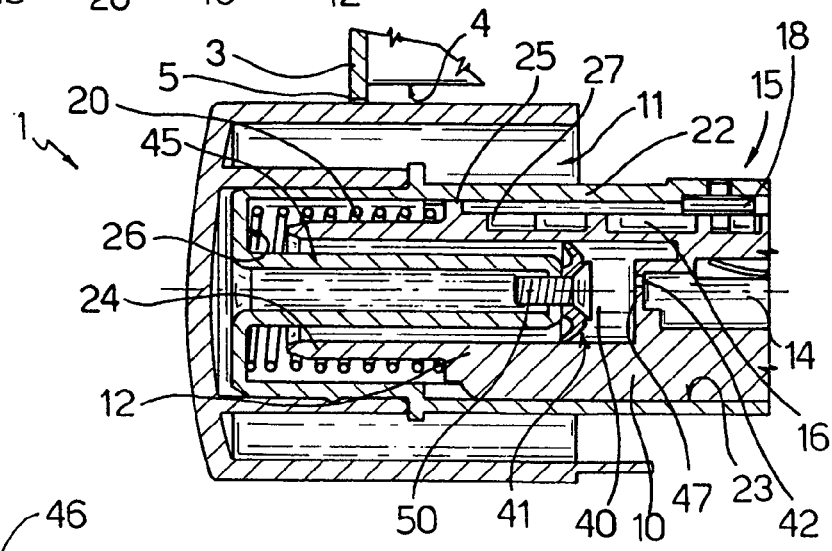
FIGS. 2 and 3 are views corresponding to that of FIG. 1 of the control knob according to the invention, represented, respectively, in a resting position retracted within said seat of the household appliance, and in a retracted end-of-stroke position.
Figure 3:
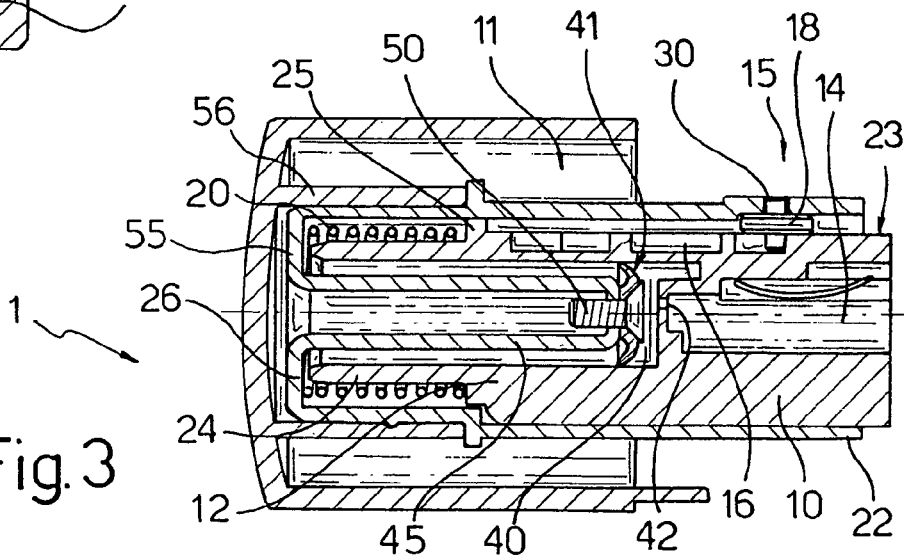

With reference to FIGS. 1 to 3, reference number 1 indicates, as a whole, a control knob of the retractable type for an electrical household appliance 2 of a known type (for example a washing machine, a dish washer, or an oven), of which, for reasons of simplicity, there is illustrated in exploded view only a portion of a body 3, which is provided, generally in the area known as "front panel", with a seat that is open at the front 4 for housing the knob 1, within which there is set, on the opposite side of a front mouth 5 of the seat 4, a rotatable control pin 6 of the household appliance, of a known type, designed to control, according to its own angular position, at least one function of the household appliance (for example, a washing or cooking program, a washing or cooking temperature, etc.)

The knob 1 comprises a hub 10, having a substantially cylindrical symmetry, which can be connected angularly, in use, within the seat 4, with pin 6, and a grip 11, which is carried so that it is angularly fixed but can slide axially on a first end 12 of the hub 10 opposite to a second end 14 thereof, which is pre-arranged, in a known way and consequently not described in detail, for fixed angular connection with the pin 6.

The knob 1 is moreover provided with a mechanism 15 for extraction/retraction of the grip 11 from/into the seat 4, of the type referred to as "push-push", in the sense that both the movement of extraction of the knob 11 from the seat 4 and the movement of retraction of the knob 11 into the seat 4, substantially flush with the outer front surface of the body 3 (FIG. 2), are controlled via pressure exerted in a direction parallel to an axis of symmetry A of the knob 1 on the grip 11, in the sense of direction indicated by the arrow in FIG. 1.

The push-push mechanism 15, of a type already known and that consequently will be described only briefly in what follows, comprises elastic means 20 set between the grip 11 and the pin 10, on the part of the end 12, and means 16, 18 for selective axial connection of the grip 11 to the hub 10, designed to block selectively the grip 11, against the action of the elastic means 20, in a first axial position (illustrated in FIG. 1), in which the grip 11 projects in cantilever fashion from the end 12 of the hub 10 and is set, in use, at least partially outside the seat 4, and in a second axial position (illustrated in FIG. 2), in which the grip 11 is fitted on the hub 10, substantially so that it occupies the entire end 12 thereof, and is, in use, retracted back into the seat 4, in the aforesaid position where it is substantially flush with the body 3 of the household appliance 2.

The grip 11 is cup-shaped, has its concavity facing the hub 10, and comprises a sleeve 22 extending axially in a cantilever fashion inside the concavity of the grip 11, the sleeve 22 being slidably coupled, substantially without any play (except for the play due to the normal tolerances of fabrication) on an outer cylindrical side surface 23 of the hub 10, for guiding the movement of axial sliding of the grip 11 with respect to the hub 10 along the axis A.

For the above purpose, the end 12 of the hub 10 has, towards the grip 11, a cylindrical portion 24 of reduced diameter (i.e., smaller than the outer diameter of the hub 10), fitted on which are the aforesaid elastic means 20, in the case in point formed by a helical spring housed within the sleeve 22 and set pack-tightened between an axial shoulder 25 of the hub 10, constituted by an annular separation step between the cylindrical portion 24 and the rest of the end 12, and an end wall 26 of the grip 11.

The spring 20 is mounted pre-loaded so as to maintain the grip 11, in use, normally in the extracted position illustrated in FIG. 1.

Made on the outer side surface 23 of the hub is a plane desmodromic path 16 of a known type, provided with shoulders for axial arrest 27, 28, 29 (see FIG. 1). In a position corresponding to the path 16, the sleeve 22 of the grip 11 is provided with an idle pin 18, which is carried, so that it moves in a direction transverse to the path 16, by a circumferential slot 30 (see FIG. 3), in which the pin 18 is engaged with play. The pin 18 can consequently slide, as a result of a relative axial motion of the grip 11 with respect to the hub 10, along two parallel branches of the path 16 (not illustrated) so as to engage selectively the shoulders 27, 28 and 29, thus providing, in a known way, the axial arrest or blocking of the grip 11 in the positions of FIGS. 1 and 2, against the shoulders 27 and 28, respectively, and cyclical displacement of the pin 18 in the slot 30 between the two branches of the path 16, against the shoulder 29.

According to the invention, the grip 11 and the hub 10 are shaped so as to define, between them, a closed chamber 40 having a volume which depends upon the axial position of the grip 11 on the hub 10. For example, the volume of the chamber 40 is maximum when the grip 11 is in the extracted position of FIG. 1, is close to the minimum when the grip 11 is in the retracted position of FIG. 2, and is minimum when the grip 11 is in a position of end of stroke, as illustrated in FIG. 3, in which the pin 18 engages the shoulder 30 so as to be displaced thereby (as already mentioned) between said two branches of the desmodromic path 16.

Furthermore, arranged between the hub 10 and the grip 11 are, according to the invention, sliding seal means 41 for sealing the air-tight chamber 40, and a calibrated restriction 42, which is carried selectively either by the hub 10 or by the grip 11 (in the non-limiting case in point illustrated, by the hub 10, as it will be explained hereinafter) to connect permanently the inside of the chamber 40 with the external environment in such a way as to enable the environmental air to flow from and into the chamber 40 only with a pre-set pressure drop, which is consequently such as to cause a variation of pressure of the air contained in the chamber 40 as a result of any axial movement of the grip 11 with respect to the hub 10.

In particular, the end 12 of the hub 10 is provided at the front (hence also through the cylindrical portion 24) with a blind hole 44 (indicated only in FIG. 1), engaged with radial play by a rod 45, which is fixedly carried by the grip 11 and extends axially in cantilever fashion inside it, coaxially with respect to the sleeve 22 and located therein.

According to the main characteristic of the invention, a free end 46 of the rod 45 carries in a fluid-tight way an annular gasket 41 providing a radial seal, which slidably co-operates with a cylindrical side wall of the blind hole 44 in such a way that the latter, together with the free end 46 of the rod 45, defines the chamber 40 which has a volume that depends upon the axial position of the grip 11 on the hub 10.

An end wall 47 (indicated only in FIG. 2) of the blind hole 44 is constituted by a separation diaphragm with a known seat 48 for connection of the hub 10 (see FIG. 1), which is designed to receive, in use, the control pin 6 of the household appliance and is made at the front inside the end 14. The end wall 47 is provided with a calibrated hole 42 (calibrated in the sense that it has a pre-set cross section for passage made with narrow tolerances) constituting, in use, the aforesaid calibrated restriction designed to enable, with a pre-set pressure drop, passage of environmental air away from and towards the chamber 40, in the case in point through the connection seat 48.

Preferably, to enable a more effective operation of the invention, the radial-seal gasket 41 is a bell-shaped lipped gasket, mounted on the rod 45 so as to have the concavity facing the grip 11, in particular facing the concavity of the grip 11.

According to the embodiment illustrated in FIGS. 1–3, the lipped gasket 41 is fixed at the front in cantilever fashion to the free end 46 of the rod 45 via connection means, in the case in point a screw 50 with countersunk head.

Figure 4:
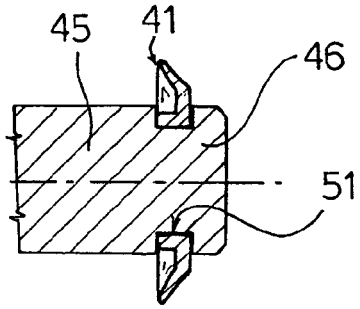
FIG. 4 illustrates a detail of a possible variant of the knob of FIGS. 1–3.

According to what is illustrated at an enlarged scale in FIG. 4, instead, the lipped gasket 41 can be carried by the free end 46 of the rod 45 inserted via snap-action in a radial annular seat 51 made thereon. In this case, the rod 45, or at least its end 46, will be made full solid, whilst in the case of the embodiment of FIGS. 1–3, the rod 45 can be made hollow.

In the latter case, the rod 45 and the sleeve 22 may conveniently be made of a single piece via a connecting portion 55 (indicated only in FIG. 3) to form a single element for connection to the hub 10, said connection element being mounted fixedly via snap-action within a sleeve-like seat 56 (see FIG. 3) of the cup-shaped grip 11, said seat being provided, in cantilever fashion, inside said grip. In this way, it is possible to apply on a single knob mechanism grips having different shapes and/or dimensions, or else bearing different indications, according to the type of household appliance 2 on which the knob 1 according to the invention is to be applied.

Operation of the knob 1 described is evident from the structural description provided. Normally, the knob 1 is in the resting configuration of FIG. 2, in which it does not present any bulk at all on the outside of the household appliance 2. As a result of a front thrust exerted by the user (for example, with just one finger) in the direction indicated by the arrow on the grip 11, which is accessible through the mouth 5, the knob 1 is brought, by compressing the spring 20, into the end-of-stroke configuration of FIG. 3, thus abandoning the axial-blocking shoulder 28. The spring 20 is consequently free to push the grip 11 towards the extracted position of FIG. 1, outside the seat 4 and through the mouth 5, until the pin 18 is brought against the axial-blocking shoulder 27 so causing blocking of the knob 1 in the configuration illustrated in FIG. 1.

During said movement of extraction of the grip 11 from the seat 4, the grip 11 slides axially with respect to the hub 10, which remains stationary, thus producing a progressive increase in the volume of the chamber 40. This causes in the chamber 40, as a result of the delay with which the environmental air can flow therein through the calibrated restriction (hole) 42, a negative pressure, which exerts a "sucking" action on the grip 11, in the case in point the end 46 of the rod 45 fixed thereto, so slowing down the movement of extraction in the desired way.

Once the grip 11 is in its extracted position, it can be gripped by the user and rotated, thus causing rotation of the hub 10 and of the control pin 6.

In order to bring the knob 1 back into the retracted configuration of FIG. 2, it is sufficient for the user to press the grip 11 again in the direction of the arrow (FIG. 1) in order to cause retraction thereof, with consequent compression of the spring 20. During said motion, the air will come out with some delay from the chamber 40, which is thus reduced in volume, through the hole 42, bringing about an over-pressure in the chamber 40 with respect to the environmental pressure; this will cause an increase in the resistance perceived by the user necessary to bring the knob to the end-of-stroke position (configuration of FIG. 3). Said increase does not, however, represent a disadvantage, in so far as it enables any accidental retraction of the knob 1 to be prevented without the need to use an excessively stiff spring 20.

Once the end-of-stroke position has been reached, the user may release the pressure on the grip 11, and the spring 20 will bring the knob 1 back into the configuration represented in FIG. 2, i.e., blocked against the shoulder 28.

The invention claimed is:

1. A retractable control knob for an electrical appliance, said control knob comprising:

a hub having opposite front and rear ends, wherein the rear end is receivable in a seat in a housing of the appliance and engageable with a control pin of the appliance in said seat, said control pin being adapted to control at least one function of the appliance;

a grip angularly fixed to, but axially slidable on, the hub;

a locking mechanism for selective axial connection of the grip to the hub and for blocking said grip at a first axial position and a second axial position axially rearwardly spaced from the first axial position;

an elastic element disposed between said hub and said grip and axially biasing said grip forwardly towards said first axial position, in which the grip projects in cantilever fashion from the front end of the hub and is set, in use, at least partially outside said seat, wherein, in said second axial position, the grip is fitted over the front end of said hub and is retracted, in use, within said seat;

a closed chamber defined between the grip and the hub and having a volume depending on a relative axial position of the grip on the hub;

a sliding seal sealing closed chamber in an airtight manner; and a calibrated orifice being carried by any of said hub and said grip for permanently fluidly connecting an interior of said chamber with the external environment for causing a variation in pressure of the air contained in said chamber as a result of an axial movement of the grip with respect to the hub, thereby dampening said axial movement;

wherein said grip is cup-shaped and has a concavity facing said hub;

said front end of said hub has a hole opening forwardly and having a rear end wall and a side wall projecting forwardly from said end wall;

a rod fixed to and carried by said grip extends axially in cantilever fashion in said hole;

a free end of said rod carries said seal which is an annular fluid-tight gasket in sliding and fluid-tight contact with the side wall of the hole, so that the side wall and the end wall of the hole, together with said free end of the rod, define said closed chamber;

said grip further comprises a sleeve coaxial to said rod, extending axially in cantilever fashion inside the grip, and slidably fitted on an outer side surface of the hub in order to guide axial sliding movement of the grip with respect to the hub;

said rod and said sleeve are integrally connected by a connecting portion so as to form a single connection element fixedly snapped within a seat defined by a further sleeve of the grip, said further sleeve extending in cantilever fashion inside said grip; and said locking mechanism is provided between the hub and the sleeve at substantially the same axial position as said closed chamber, thereby reducing an overall axial dimension of said knob.

2. The knob according to claim 1, wherein said side wall further extends rearwardly beyond said end wall to define said rear end of said hub, said rear end being hollow to receive therein the pin of the appliance; and the calibrated orifice is formed through said end wall of said hole.

3. The knob according to claim 1, wherein said elastic element is a helical spring housed inside said sleeve and compressed between a shoulder of the hub and an end wall of the grip; and said side wall of said hole has a front portion which faces said grip and has a reduced outer diameter to define said shoulder.

4. The knob according to claim 1, wherein said gasket is a bell-shaped lipped gasket having its concavity facing the grip.

5. The knob according to claim 4, wherein said lipped gasket is fixed to said free end of said rod via a screw.

6. The knob according to claim 4, wherein said lipped gasket is retained in an annular seat formed in said free end of said rod.

7. The knob according to claim 1, wherein said locking mechanism is provided between the side wall of the hole and the sleeve at substantially the same axial position as said end wall of said hole.

8. The knob according to claim 7, wherein said locking mechanism comprises a desmodromic path formed in an outer surface of the side wall of the hole; and a pin carried on an inner surface of said sleeve and moveable along said path as a result of relative axial movement between said grip and said hub.

9. The knob according to claim 8, wherein a substantial axial extent of said path is located forward of said end wall of said hole.

10. A retractable control knob for an electrical appliance, said control knob comprising;

a hub having opposite front and rear ends, wherein the rear end is receivable in a seat in a housing of the appliance and engageable with a control pin of the appliance in said seat, said control pin being adapted to control at least one function of the appliance;

a grip angularly fixed to, but axially slidable on, the hub;

a locking mechanism for selective axial connection of the grip to the hub and for blocking said grip at a first axial position and a second axial position axially rearwardly spaced from the first axial position;

an elastic element disposed between said hub and said grip and axially biasing said grip forwardly towards said first axial position, in which the grip projects in cantilever fashion from the front end of the hub and is set, in use, at least partially outside said seat, wherein, in said second axial position, the grip is fitted over the front end of said hub and is retracted, in use, within said seat;

a closed chamber defined between the grip and the hub and having a volume depending on a relative axial position of the grip on the hub;

a sliding seal sealing said closed chamber in an airtight manner; and a calibrated orifice being carried by any of said hub and said grip for permanently fluidly connecting an interior of said chamber with the external environment for causing a variation in pressure of the air contained in said chamber as a result of an axial movement of the grip with respect to the hub, thereby dampening said axial movement;

wherein said grip has a concavity facing said hub;

said front end of said hub has a hole opening forwardly and having a rear end wall and a side wall projecting forwardly from said end wall;

a rod carried by said grip extends axially in cantilever fashion in said hole;

a free end of said rod carries said seal which is an annular fluid-tight gasket in sliding and fluid-tight contact with the side wall of the hole, so that the side wall and the end wall of the hole, together with said free end of the rod, define said closed chamber;

said grip further comprises a sleeve coaxial to said rod and slidably fitted on an outer surface of the side wall in order to guide axial sliding movement of the grip with respect to the hub; and said locking mechanism is provided between the hub and the sleeve at substantially the same axial position as said closed chamber, thereby reducing an overall axial dimension of said knob.

11. The knob according to claim 10, wherein said side wall further extends rearwardly beyond said end wall to define said rear end of said hub, said rear end being hollow to receive therein the pin of the appliance; and the calibrated orifice is formed through said end wall of said hole.

12. The knob according to claim 10, wherein said elastic element is a helical spring housed inside said sleeve and compressed between a shoulder of the hub and an end wall of the grip; and said side wall of said hole has a front portion which faces said grip and has a reduced outer diameter to define said shoulder.

13. The knob according to claim 10, wherein said gasket is a bell-shaped lipped gasket having its concavity facing the grip.

14. The knob according to claim 13, wherein said lipped gasket is fixed to said free end of said rod via a screw.

15. The knob according to claim 13, wherein said lipped gasket is retained in an annular seat formed in said free end of said rod.

16. The knob according to claim 12, wherein said rod and said sleeve are integrally connected by a connecting portion so as to form a single connection element fixedly snapped within a seat defined by a further sleeve of the grip, said further sleeve extending axially rearwardly from the end wall of said grip in cantilever fashion inside said grip.

17. The knob according to claim 10, wherein said locking mechanism is provided between the side wall of the hole and the sleeve at substantially the same axial position as said end wall of said hole.

18. The knob according to claim 17, wherein said locking mechanism comprises a desmodromic path formed in an outer surface of the side wall of the hole; and a pin carried on an inner surface of said sleeve and moveable along said path as a result of relative axial movement between said grip and said hub.

19. The knob according to claim 18, wherein a substantial axial extent of said path is located forward of said end wall of said hole.

* * * * *